US011037745B2

(12) United States Patent
Mondellini et al.

(10) Patent No.: US 11,037,745 B2
(45) Date of Patent: Jun. 15, 2021

(54) CONTACTOR DEVICE FOR HIGH CURRENT SWITCHING APPLICATIONS

(71) Applicant: MICROELETTRICA SCIENTIFICA S.P.A., Buccinasco (IT)

(72) Inventors: Claudio Mondellini, Treviglio (IT); Marco Corna, Almenno San Salvatore (IT); Lorenzo Stendardi, Milan (IT)

(73) Assignee: MICROELETTRICA SCIENTIFICA S.P.A.

( * ) Notice: Subject to any disclaimer, the term of this patent is extended or adjusted under 35 U.S.C. 154(b) by 115 days.

(21) Appl. No.: 16/331,881

(22) PCT Filed: Sep. 8, 2017

(86) PCT No.: PCT/EP2017/072650
§ 371 (c)(1),
(2) Date: Mar. 8, 2019

(87) PCT Pub. No.: WO2018/046695
PCT Pub. Date: Mar. 15, 2018

(65) Prior Publication Data

US 2019/0214205 A1 Jul. 11, 2019

(30) Foreign Application Priority Data

Sep. 9, 2016 (EP) ..... 16188082

(51) Int. Cl.
*H01H 33/59* (2006.01)
*H01H 3/28* (2006.01)
(Continued)

(52) U.S. Cl.
CPC ..... *H01H 33/596* (2013.01); *H01H 3/28* (2013.01); *H01H 9/362* (2013.01); *H01H 9/443* (2013.01); *H01H 2003/466* (2013.01)

(58) Field of Classification Search
CPC ..... H01H 9/362; H01H 9/38; H01H 9/443; H01H 33/596; H01H 3/28; H01H 2003/466
(Continued)

(56) References Cited

U.S. PATENT DOCUMENTS 4,550,234 A 10/1985 Steinemer
4,635,014 A 1/1987 Erb et al.
(Continued)

FOREIGN PATENT DOCUMENTS

CN 101118817 A 2/2008
CN 102237230 A 11/2011
(Continued)

OTHER PUBLICATIONS

International Search Report and Written Opinion for International Patent Application No. PCT/EP2017/072650; dated Nov. 7, 2017.
(Continued)

*Primary Examiner* — Yemane Mehari
(74) *Attorney, Agent, or Firm* — Barnes & Thornburg LLP

(57) ABSTRACT

An improved contactor device for high current switching applications, in particular industrial or railways applications, is provided, wherein a high DC current must be switched on and off, the contactor device includes a switch base portion including an electric switching mechanism of a high voltage portion and an arc extinguishing portion covering the switching mechanism. The contactor device includes a couple of moving contacts driven towards and away from each other with respect to a mutual contact and abutting position, those moving contacts being mounted at the respective contact ends of a toggle mechanism activated by a low voltage driving portion incorporated in the switch base portion and active on the toggle mechanism.

14 Claims, 10 Drawing Sheets

(51) Int. Cl.

| | |
|---|---|
| ***H01H 9/36*** | (2006.01) |
| ***H01H 9/44*** | (2006.01) |
| *H01H 3/46* | (2006.01) |

(58) Field of Classification Search
USPC ..... 361/3
See application file for complete search history.

(56) References Cited

U.S. PATENT DOCUMENTS

| | | | | |
|---|---|---|---|---|
| 7,417,520 | B2 * | 8/2008 | Kralik | H01H 9/34 200/10 |
| 9,558,899 | B2 * | 1/2017 | Kreuzpointner | H01H 33/08 |
| 2013/0284703 | A1 | 10/2013 | Yoshitomo et al. | |
| 2013/0292359 | A1 * | 11/2013 | Kralik | H01H 9/362 218/148 |

FOREIGN PATENT DOCUMENTS

| | | | |
|---|---|---|---|
| CN | 104979116 | A | 10/2015 |
| CN | 206379313 | U | 8/2017 |
| DE | 1140997 | B | 12/1962 |
| DE | 1515692 | A1 | 11/1969 |
| EP | 0115739 | A1 | 8/1984 |
| EP | 1884969 | A2 | 2/2008 |
| EP | 2227330 | A2 | 9/2010 |
| EP | 2385537 | A1 | 11/2011 |
| EP | 2927927 | A1 | 10/2015 |
| GB | 1103746 | | 2/1968 |
| RU | 2439737 | C2 | 9/2010 |
| RU | 162074 | U1 | 5/2016 |

OTHER PUBLICATIONS

European Search Report for European Application No. 16 18 8082 dated Dec. 2, 2016.

* cited by examiner

CONTACTOR DEVICE FOR HIGH CURRENT SWITCHING APPLICATIONS

CROSS REFERENCE AND PRIORITY CLAIM

This patent application is a U.S. National Phase of International Patent Application No. PCT/EP2017/072650, filed Sep. 8, 2017, which claims priority to European Patent Application No. 16188082.8, filed Sep. 9, 2016, the disclosure of which being incorporated herein by reference in their entireties.

FIELD

Disclosed embodiments relate to an improved contactor device for high current switching applications. More specifically, but not exclusively, the disclosed embodiments relate to a contactor device for industrial or railways applications wherein a high D.C. current must be switched on and off with high frequencies switching actions.

BACKGROUND

As it is well known in this specific technical field, contactors are remote control switches with an electromagnetic actuator. Generally speaking, a distinction is made between a control circuit for a contactor with a contactor coil and a load circuit for a contactor to be switched with the connected loads. In many cases, as soon as a sufficient starting current flows through the contactor coil, the contactor responds and turns on the loads connected in the load circuit. To maintain the contactor in this state, a holding current must flow through the contactor. After the holding current is switched off, the contactor drops out. The energy stored in the contactor coil is dissipated in a free-wheeling circuit. The contactors of this known structure normally include a fixed contact and a movable contact. Both contacts are linked to a branch of the power supply line to be connected and disconnected by bridge connectors or metal flexible connectors such as a copper braid. In particular, the movable contact is generally connected to the power supply terminal through a flexible connecting braid.

The relatively high operating frequency of the switching device solicits very much the flexible connecting braid that suffers for failures reducing the lifetime of the switching device. Moreover, the movable contact is subject to a relatively high excursion with respect to the fixed contact in order to provide an effective sufficient opening space when the current flow must be interrupted without raising an excessive electric arc.

In order to guarantee an efficient switching action the movable contact is mounted on a mechanical moving system that requires a complex structure and a delicate angular movement sufficient to create a predetermined space between the contacts.

The known moving mechanisms of the moving contact are generally complex, expensive and do not allow to realize a compact design of the contactor device.

SUMMARY

The technical problem underlying the disclosed embodiments is that of providing an improved contactor device for high current switching applications having structural and functional characteristics to allow improving the overall performances of the switching device while obtaining a more compact physical structure. Another aim of the disclosed embodiments is to provide a contactor device having a higher reliability and a longer lifetime. Additionally, disclosed embodiments provide a contactor device that does not require any specific maintenance action or mechanical adjustment during its working life.

DETAILED DESCRIPTION

Figure 1:
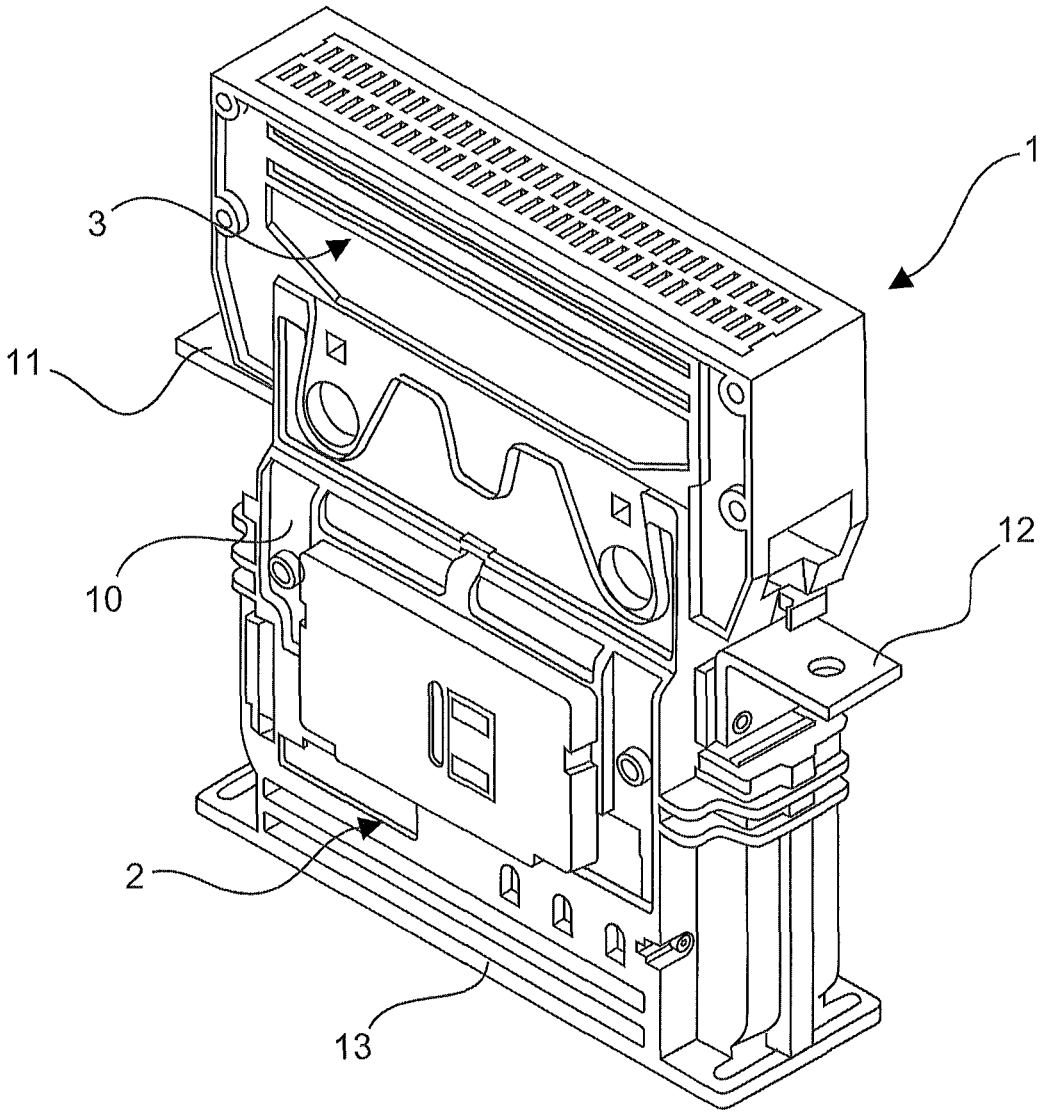
FIG. 1 shows a schematic and perspective view of a contactor device realized according to disclosed embodiments.

The solution idea at the basis of the disclosed embodiments is that of removing the fixed contact from the contactor device while providing a couple of movable contacts driven towards and away from each other with respect to a mutual contact position. According to the above solution idea, the technical problem is solved by an improved contactor device for high current switching applications, in particular industrial or railways applications wherein a high D.C. current must be switched on and off, the contactor device including a switch base portion including electric switching mechanism of a high voltage portion and an arc extinguishing portion covering the switching mechanism, characterized by comprising a couple of moving contacts driven towards and away from each other with respect to a mutual contact and abutting position, the contacts being mounted at the respective contact ends of a toggle mechanism activated by a low voltage driving portion incorporated in the switch base portion and active on the toggle mechanism.

The mentioned moving contacts are symmetrical and are positioned at the respective contact end of a corresponding elongated arm of the toggle mechanism.

Optionally, the toggle mechanism includes a couple of rods having a corresponding end joined in a sliding hinge that may be moveable up and down along a vertical slot of a frame in the switch base portion; the rods being made by an insulating material and having respective opposite ends hingedly coupled to a corresponding end of the arms opposite to the contacts, respectively.

Optionally, each end of the arms opposite to the contacts are sustained by a corresponding elongated portion of an element made by the same insulating material of the rods and linked, optionally hingedly linked, to a respective of the opposite ends.

Furthermore, optionally, the elongated arm is pivotally supported in a frame of the switch base portion by a corresponding pivot electrically connected to fixed terminal power contacts projecting outside the switch base portion.

Optionally, each of the arms is supported by the corresponding pivot extended transversally at the end of a fork like arm each linked to one corresponding of the fixed terminal power contacts.

It should be further noted that the sliding hinge is optionally contacted by an active end of the low voltage driving portion.

Optionally, the low voltage driving portion includes a coil active on a stem having a free distal end linked to one end of a lever which is pivotally mounted on a fulcrum fixed or integral with an internal frame of the switch base portion; the lever having a second arm with a free end active on the toggle mechanism to activate the switching of the moving contacts.

Optionally, an element is interposed between each arm and the corresponding supporting fork like arm for compensating possible degradation or usury of the contacts.

Moreover, optionally, an arc runner is provided over each of the moving contacts and each of the arc runner is electrically connected to a respective dissipation coil provided at the shoulder of each contact end of each of the arm.

Optionally, a couple of lateral metal flanges are laterally associated to each moving contact; each metal flange having a projecting flag toward the corresponding arc runner.

Optionally, a polar metal plate expansion is provided on both sides of the moving contacts.

Finally, it must be noted that the disclosed embodiments may be implemented in a power electric system including at least a contactor device as disclosed in the following description.

Further features and advantages of the contactor device of the disclosed embodiments will appear from the following description given by way of non limiting example with reference to the enclosed drawings.

With reference to the drawings, reference numeral 1 denotes a globally and schematically shown contactor realized according to the disclosed embodiments. The contactor 1 is specifically provided for industrial or railways applications wherein a high D.C. current must be switched on and off for high frequencies switching actions.

Just to give an idea of the working conditions and the range of current values involved for these kind of contactors, it should be noted that these devices must be able to efficiently switch currents at least in the range between 400 A to 1800 A and under operating voltage ranges between 1000 V and 4000 V.

Those operating ranges may even be referred to a single pole of the contactor. In many applications it is, however, necessary to provide a double pole configuration and/or a three poles configuration.

Figure 1A:
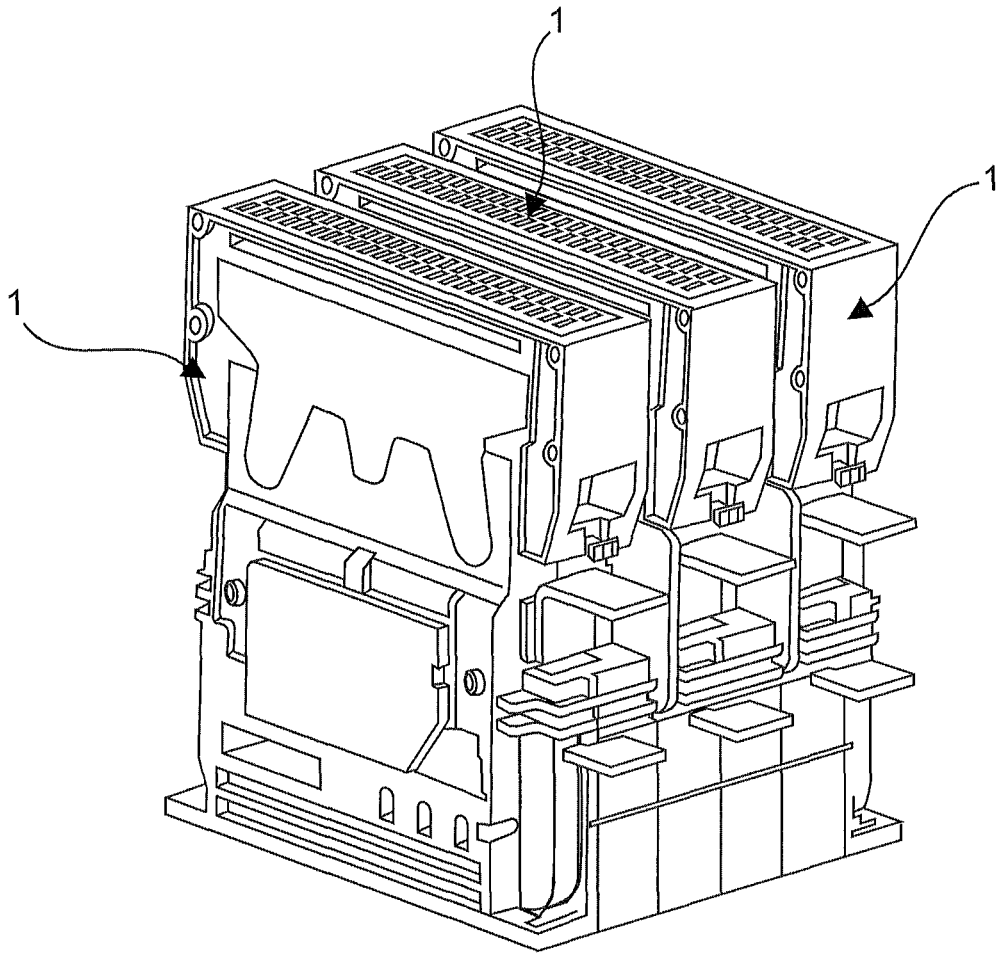
FIG. 1A shows a schematic and perspective view of a multipolar structure including three contactor devices of the disclosed embodiments forming a 3-poles modular combination.

In this respect, the contactor 1 of the disclosed embodiments has a modular structure concerning a single pole configuration that may be doubled or provided in a three poles configuration including three parallel modules according to the user's needs, for instance as shown in FIG. 1A.

In the following lines we will disclose just the structure of a single pole module. The module presents an envelope or housing 10 including all the moving portions of the contactor device 1 that will be disclosed hereinafter. The envelope 10 is made by a synthetic plastic material having a predetermined isolation coefficient. Such an envelope 10 has a base flange 13 and includes an internal frame 20 supporting the various moving components of the contactor 1.

It should be noted that fixed terminal power contacts 11 and 12 are provided for the contactor 1. Those fixed contacts 11, 12 project on opposite lateral sides of the envelope 10. Those terminal power contacts 11, 12 are each associated to a corresponding internal moving contact 21, 22 provided inside the contactor device 1, as will be explained hereinafter.

The contactor 1 of the disclosed embodiments is structured to be used on electrical equipment working in presence of severe shocks and vibrations that normally occur onboard of traction vehicles.

However, nothing refrains from employing this kind of contactors 1 in all the applications wherein a high D.C. current must be switched on and off, for instance: line contactors, power switches or converters, traction motors, electromagnetic brakes and heating/air conditioning systems.

The contactor 1 comprises a switch base portion 2 and an upper arc extinguishing portion 3.

The switch base portion 2 is common for each different modular contactor 1 and corresponds to the envelope 10 while the upper arc extinguishing portion 3 may be considered a top coverage of the envelope 10 that may have a different size according to the different power category and voltage ranges that the contactor shall provide. The switch base portion 2 includes electrical switching mechanism and the arc extinguishing portion 3 is provided to cover and/or protect the electrical switching mechanism.

Therefore, the upper arc extinguishing portion 3 may be structurally different according to the different voltage ranges that must be treated and the corresponding arc chute type and energy capacity that shall be extinguished in total security.

Figure 1B:
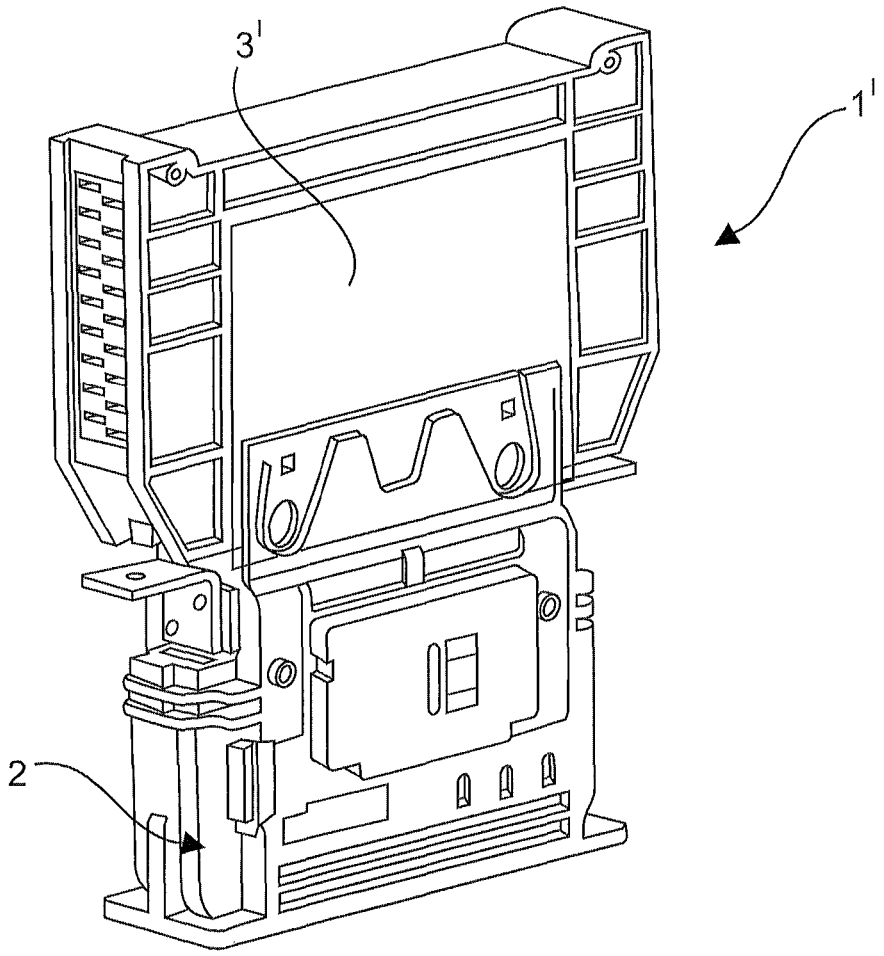
FIG. 1B shows a schematic and perspective view of a single pole contactor according the disclosed embodiments but including an upper extinguishing arc portion different from that shown in FIG. 1.

For instance, an arc extinguishing portion 3 for a voltage value of 1000 V may have the structure shown in FIG. 1 while an arc extinguishing portion 3' for a voltage value of 3000 V may require a greater or thicker portion 3' including several discharge mechanism or larger polar expansions as shown for instance in the embodiment of contactor 1' of FIG. 1B.

The common switch base portion 2 is the core of the contactor 1 or V according to the disclosed embodiments.

Figure 2:
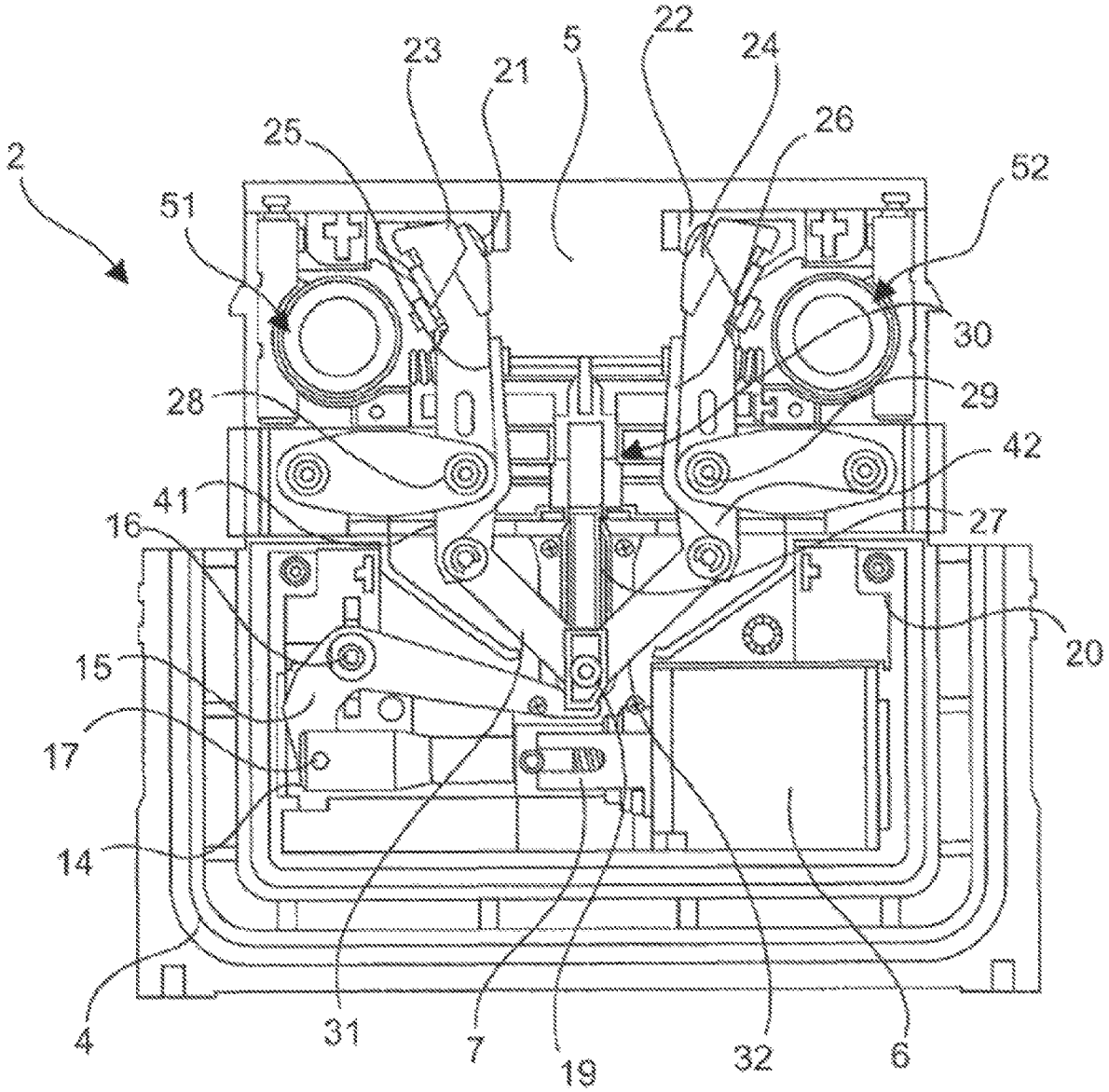
FIG. 2 shows a front internal view of a base portion of the contactor device of FIG. 1.

The internal schematic structure of this switch base portion 2 including the electrical switching mechanism of the disclosed embodiments is shown in FIG. 2. The switch portion 2 may be considered separated in a lower low voltage portion 4 and a higher high voltage portion 5. The low voltage portion 4 is provided for driving the switching of the upper high voltage portion 5.

The contactor 1 of the disclosed embodiments may be considered a monostable element that may be provided with normally closed contacts or normally open contacts according to the user's needs.

In this respect, according to the disclosed embodiments, the switching portion 2 includes a couple of moving electric contacts 21 and 22 which shall be put in abutment one against the other for allowing the passage or flow of the high DC current. Advantageously, the electrical contacts 21, 22 are symmetrically moving towards and away from each other.

It must be noted that the contactor 1, 1' of the disclosed embodiments, contrary to the known solutions, has no fixed contacts but a couple of reciprocally symmetrically moving contacts driven towards and away from each other with respect to a mutual contact and abutting position.

Figure 3:
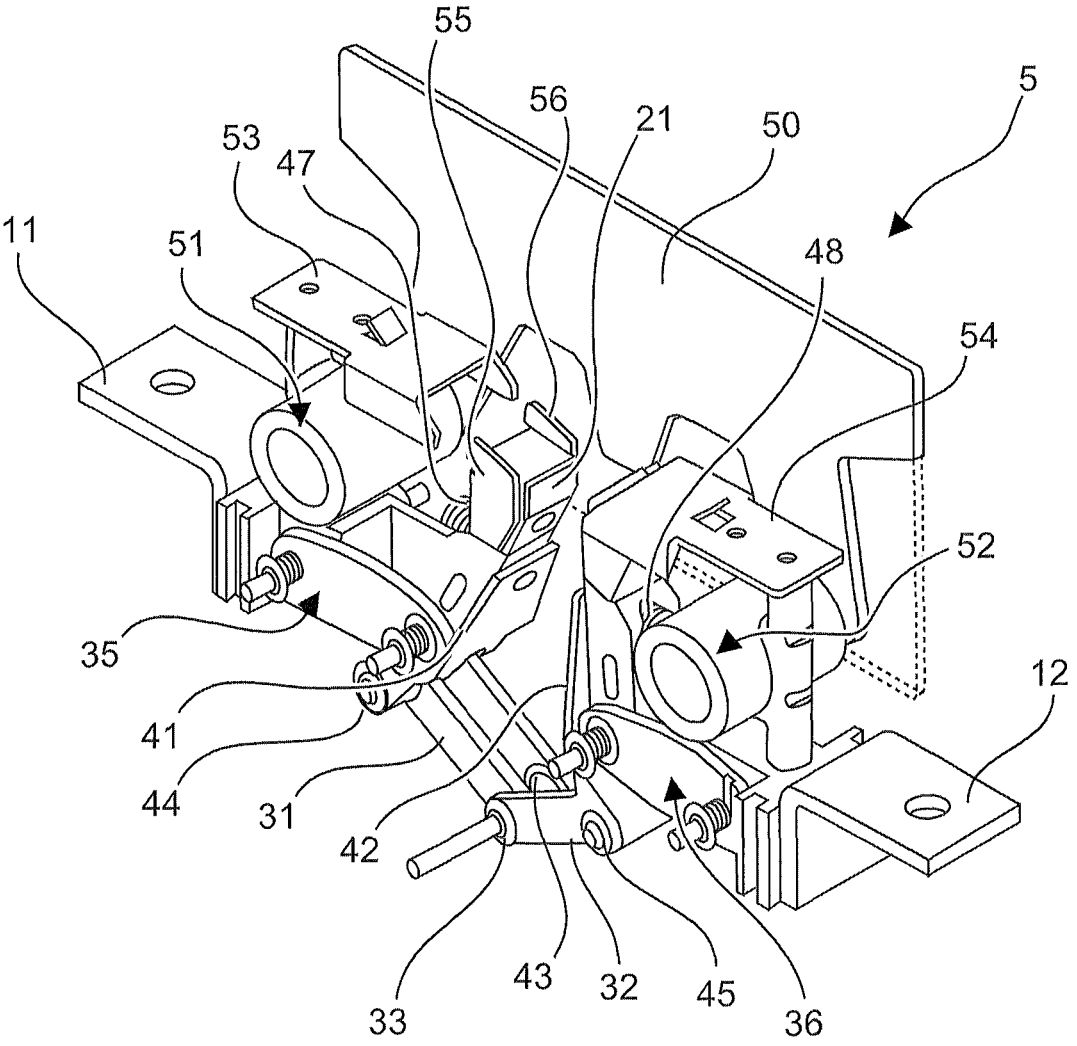
FIG. 3 shows a schematic and perspective view of an upper portion of the base portion of the contactor device of FIG. 2.
Figure 4:
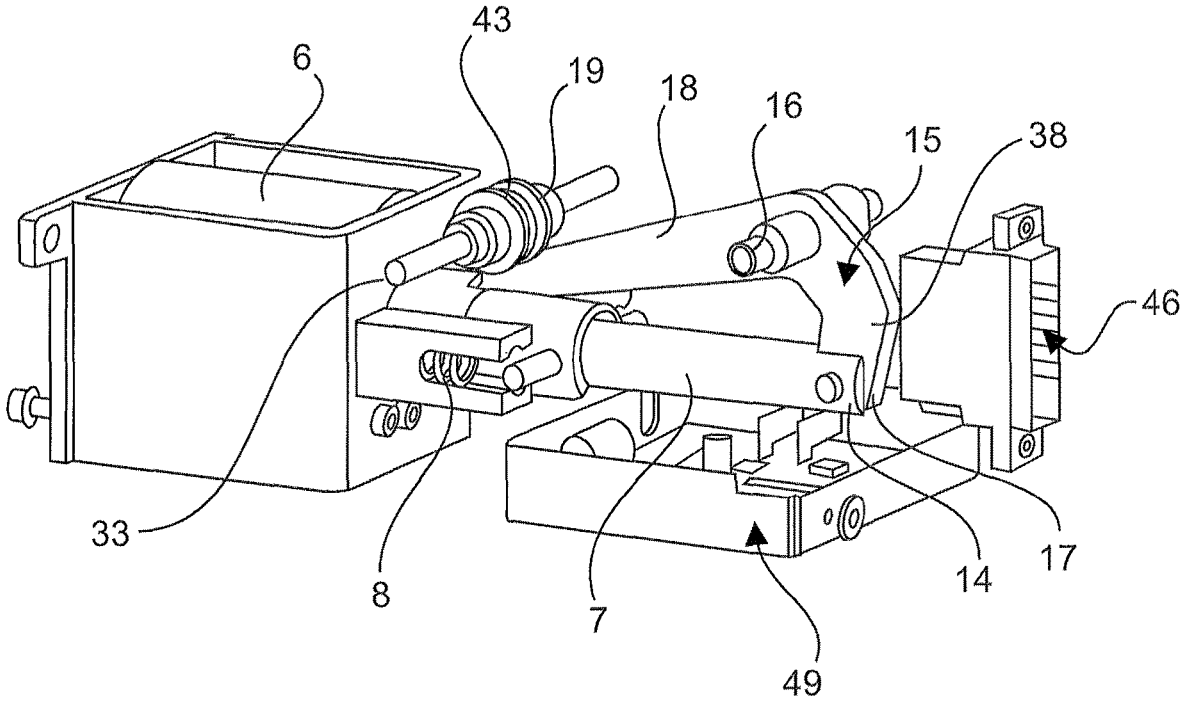
FIG. 4 shows a schematic and perspective view of a lower portion of the base portion of the contactor device of FIG. 2.

Each moving contact 21 or 22 is positioned at the contact end 23 or 24 of a corresponding elongated arm 25, 26 of a toggle mechanism 30, as shown in FIGS. 2 and 3 and disclosed hereinafter. The arms 25, 26 are manufactured by a conductive material, for instance a metal.

Over the contacts 21, 22, but still in the switch base portion 2, respective arc runners 53, 54 are provided.

Those arc runners 53, 54 help dissipating the electric arc formed during the opening phase of the moving contacts 21, 22. More particularly, each of the arc runner is electrically connected to a respective dissipation coil 51, 52 provided at the shoulder of each contact end 23, 24 of each arm 25, 26. To each moving contact 21 or 22 it is associated a couple of lateral metal flanges 55, 56 having a projecting flag toward the corresponding arc runner 53 or 54.

Moreover, a polar expansion 50, that is to say a metal plate or flange, is provided on both sides of the moving contacts 2, 22.

FIG. 3 shows just one of these metal plates 50 but it should be considered also the presence of a corresponding plate situated in a parallel position on the other side of the contacts 21, 22.

Figure 7A:
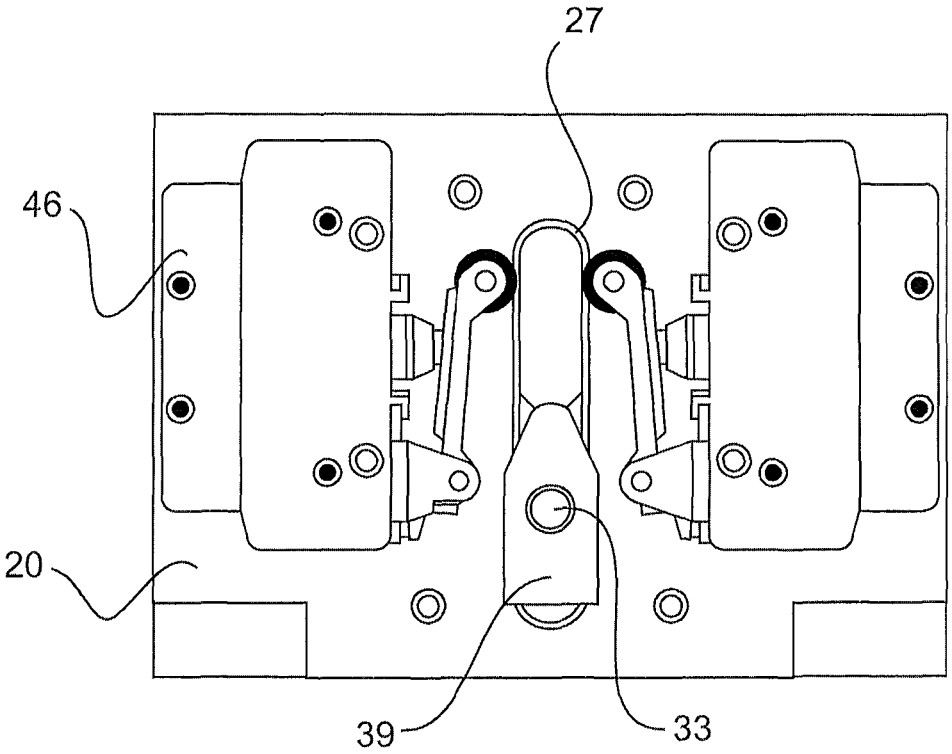
FIGS. 7A and 7B show schematic views of a particulars of the contactor device of the disclosed embodiments in two different operating conditions, respectively.
Figure 7B:
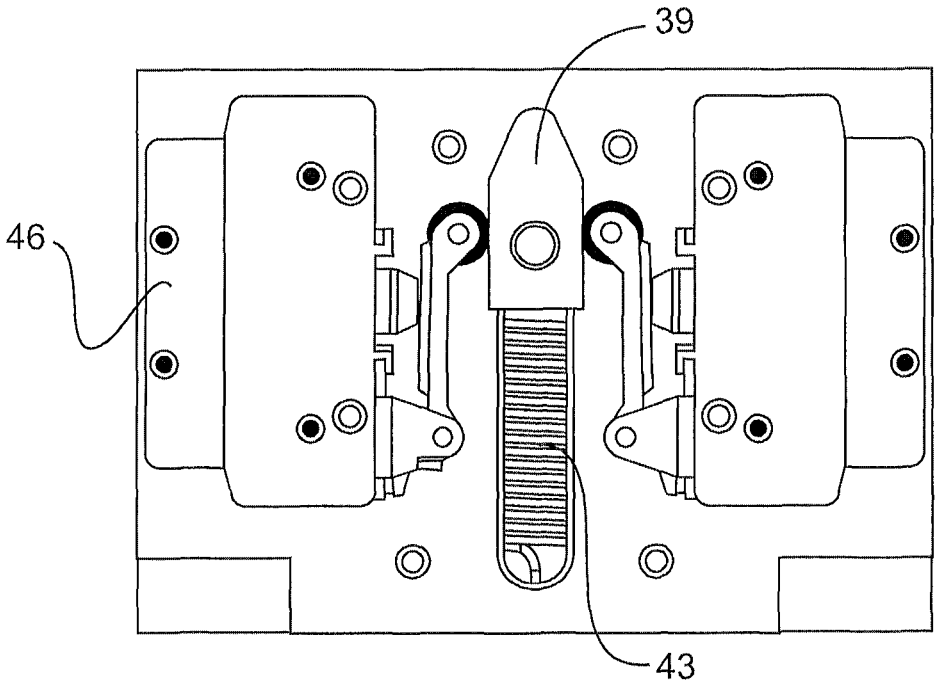
Figure 8:
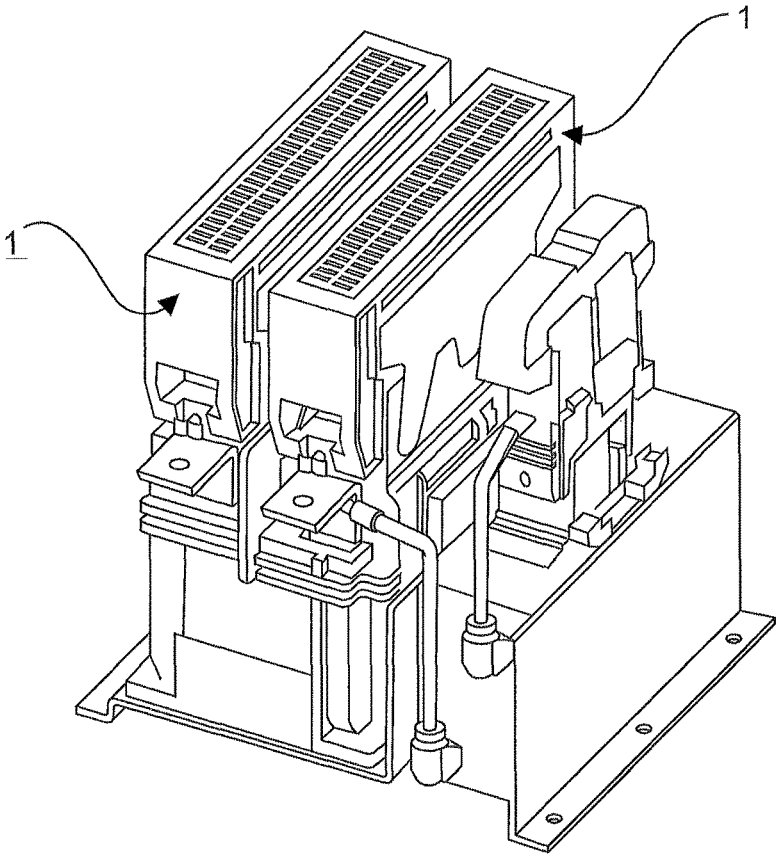
FIG. 8 shows a schematic and perspective view of the contactor device of the disclosed embodiments incorporated into a more complex power system or structure, for instance a system with two poles, pre-charge contactor and a pre-charge resistor.

The toggle mechanism 30 includes a couple of rods 31 and 32 that have a corresponding end joined in a sliding hinge 33 that may be moveable up and down along a vertical slot 27 of the frame 20, as shown in FIGS. 7A and 7B. The rods 31 and 32 are made by an insulating material, for instance a thermosetting material.

The opposite ends 44, 45 of each of the rods 31, 32 are linked, optionally hingedly linked, to a corresponding end of the arms 25 and 26, opposite to the contacts 21, 22, respectively. More specifically, each end of the arms 25, 26 opposite to the contacts 21, 22 sustained by a corresponding elongated portion 41, 42 of an element made by the same insulating material of the rods 31, 32.

Those elongated portions 41, 42 are linked, optionally hingedly linked, to the relative rod 31 or 32 but are also linked to the corresponding end of each arm 25, 26 so that the movement of the elongated portions 41, 42 reflects in a movement of the associated arm 25, 26.

Each arm 25 or 26 is pivotally supported in the frame 20 by a corresponding pivot 28, 29. Each of the arms 25, 26 is pivotally supported by the corresponding pivot 28 or 29 in a position that corresponds substantially to one third of the whole longitudinal length of the arm.

The rods 31, 32 and the arms 25, 26, together with the corresponding hinge joint 33, the pivots 28, 29 and the links between the rods 31, 32 with the elongated portions 41, 42, and indirectly with the arms 25, 26, form the toggle mechanism 30 that allows driving the moving electric contacts 21 and 22 one toward the other and vice versa. The toggle mechanism is activated by the low voltage driving portion 4 that will be disclosed later.

The rods 31, 32 as well as the arms 25, 26 are formed by a couple of identical parallel components that are linked together more or less like a truss beam.

As the before, each of the arms 25, 26 is supported by the corresponding pivot 28, 29 but those pivots are extended transversally at the end of a fork like arm 35 or 36 respectively. Those fork arms 35, 36 are made by a conductive material such as a metal.

Those fork arms 35, 36 are substantially linked to the fixed terminal power contacts 11 and 12. Therefore, the electric continuity between the moving electric contacts 21, 22 and the fixed terminal contacts 11, 12 is guaranteed by the metal continuity between the components 11, 35, 25 and 21 at one side and 12, 36, 26, and 22 on the other side.

It must be further noted that an elastic element 47 or 48, for instance a compression spring, is interposed between each arm 25 or 26 and the corresponding supporting fork like arm 35, 36 with the purpose to compensate possible degradation or usury of the moving contacts 21, 22.

The hinge joint 33 is provided with a central annular elastic element 43 that is contacted by an active end 19 of the low voltage driving portion 4 and may be considered a bumper between the active end 19 and the whole toggle mechanism 30. This hinge joint 33 is forced to slide along the vertical slot 27 by a sliding guide 39 that is visible in the FIGS. 7A and 7B wherein it is shown in two different functioning positions corresponding to the open (down) and close (up) contacts.

Coming back just to the low voltage driving portion 4, such a portion includes a coil 6 that is electrically supplied by a low voltage reference potential, non shown being of a conventional type and driven by a suitable switching actuator.

The coil 6 is active on a stem 7 that is extended horizontally and parallel to the base flange 13 of the contactor envelope 10 inside the switch base portion 2. The stem 7 is moved against the contrast of an elastic element 8, for instance an elongated spring to be compressed.

The free or distal end 14 of the stem 7 is linked to one end 17 of a lever 15 which is pivotally mounted on a fulcrum 16 fixed or integral with the internal frame 20 of switch base portion 2 of the contactor 1.

The lever 15 has a first arm 38 linked to the free distal end 4 of the stem 7 and another or second arm 18 free to move around the fulcrum when the lever 15 is actuated by the coil 6 and the stem 7.

The free end 19 of this second arm 18 is active on the hinge joint 33 of the toggle mechanism 30 through the annular elastic element 43.

It should be finally noted that an electric circuit 49 is provided for the supplying the coil 6 with different voltage values according to the different driving actuators of the low voltage driving portion. This circuit 49 is substantially a voltage level shifter suitable to receive a plurality of different voltage values. Moreover, a chopper relay device 46 is also available in the low voltage driving portion 4 for connecting all possible intermediate circuits.

In view of the previous description it should be evident the functioning of the contactor device 1 of the disclosed embodiments.

According to the solution idea at the basis of the disclosed embodiments, in the contactor device 1 there is no fixed contact but, on the contrary, a couple of movable contacts driven towards and away from each other with respect to a mutual contact position.

Figure 5:
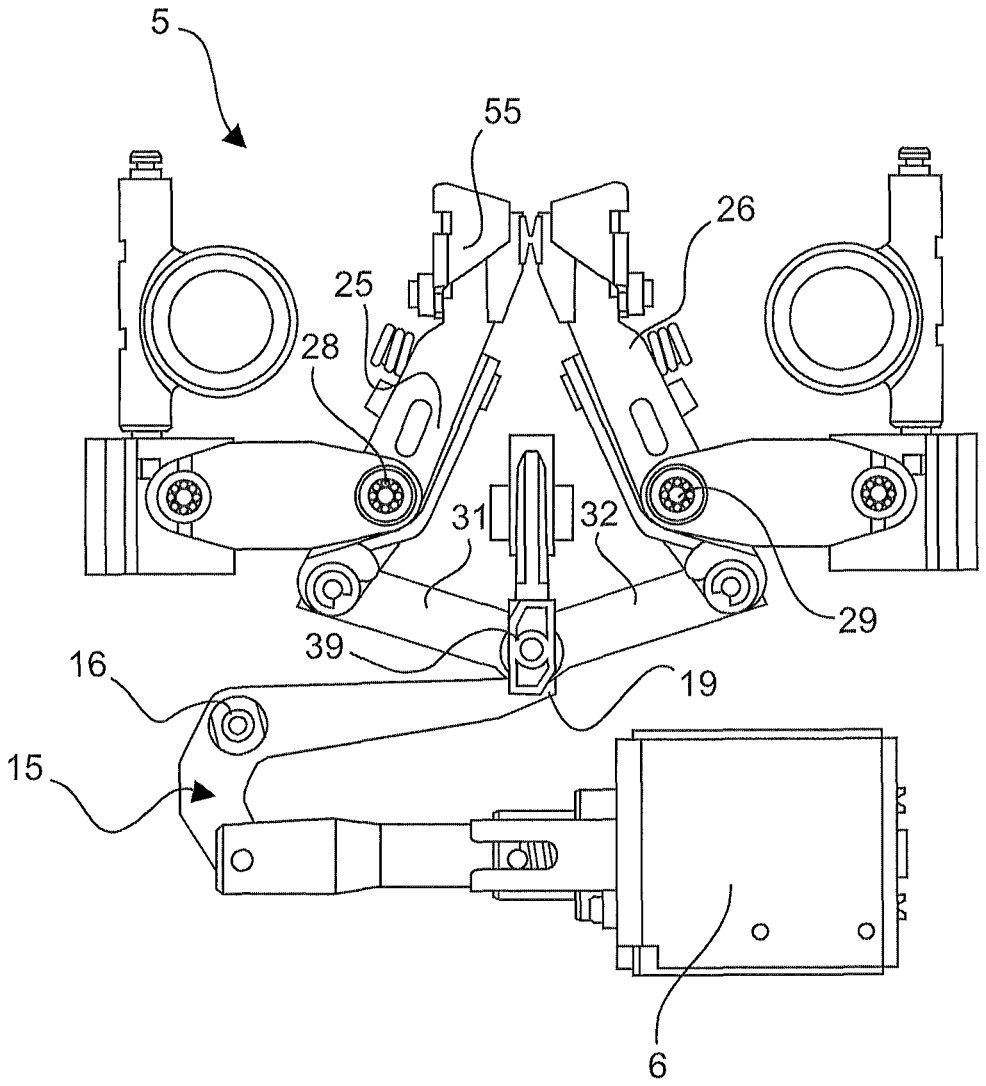
FIGS. 5 and 6 are schematic views of internal contact particulars of the contactor device of the disclosed embodiments in two different operating conditions.
Figure 6:
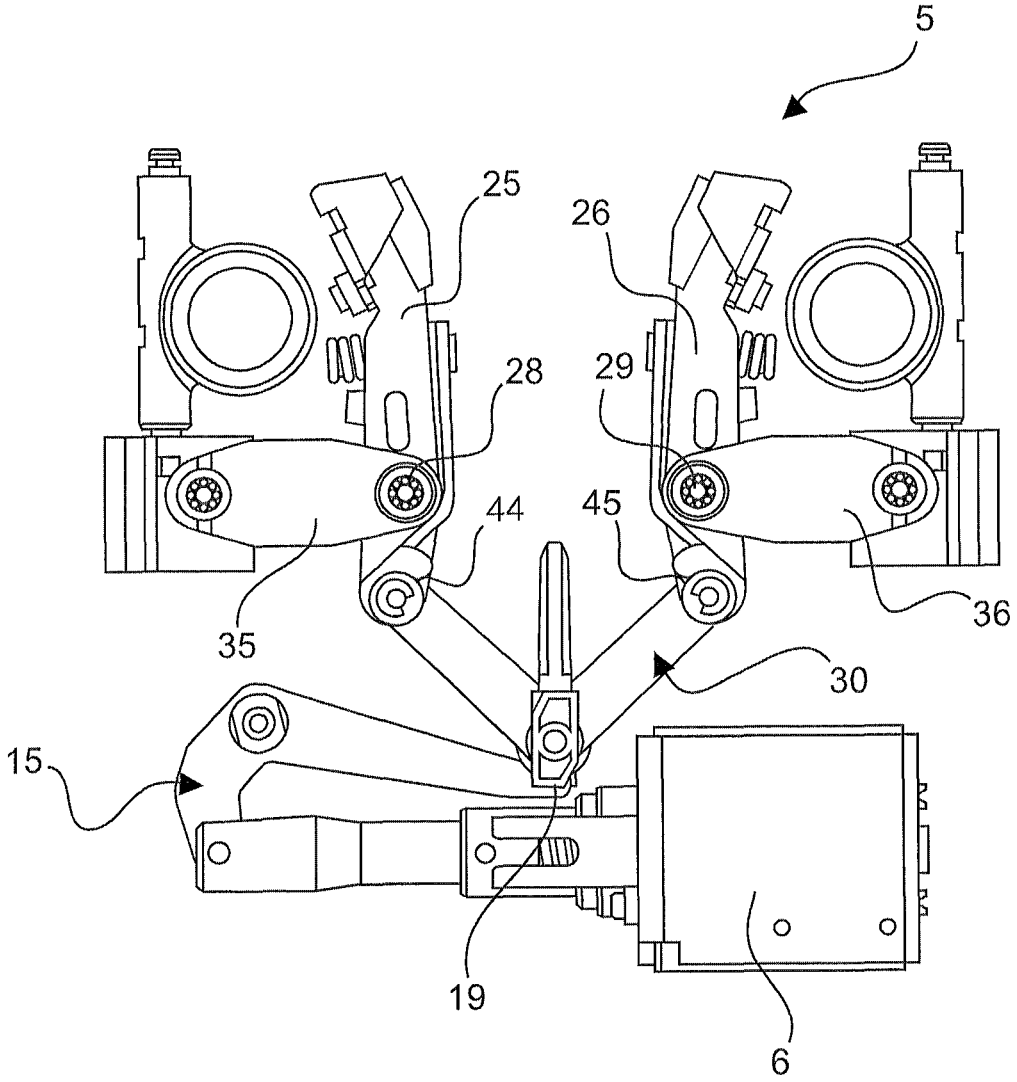

As clearly shown in the example of the FIGS. 5 and 6, according to the user's needs, the contactor may have an initial open contacts configuration or a close contacts configuration.

In any case, according to the set initial conditions, the coil 6 of the low voltage driving portion 4 is biased to move the stem 7 that is joined to one end 17 of the two arms lever 15 pivotally hinged on the fulcrum 16.

The movement of the stem 7, in contrast with the elastic element 8, and the linked lever 15 moves the free end 19 of the lever that acts on the sliding hinge 33 of the toggle mechanism 30.

That sliding hinge 33 is free to move up and down or axially along a slot of the frame 20 so to push up or down and this movement forces the whole toggle mechanism 30 to provide a closure or an aperture of the moving contacts 21, 22 according to the desired needs.

The structure of the double symmetrically moving contacts 21, 22 of the disclosed embodiments allows obtaining a physical separation of the contacts of at least 73 mm that allows reducing the risk of electric arc and renders particularly reliable the switching of the contactor device of the disclosed embodiments.

The contactor according to the disclosed embodiments may be used also for switching in high AC current applications.

In the previous lines the directional terms like: "forward", "rearward", "front", "rear", "up", "down", "above", "below", "upward", "downward", "top", "bottom", "side", "vertical", "horizontal", "perpendicular" and "transverse" as well as any other similar directional terms refer just to the device as shown in the drawings and do not relate to a possible use of the same device. Accordingly, these directional terms, as utilized to describe the contactor in its upright vertical position on a horizontal surface have just the meaning to identify a portion of the device with respect to another portion as shown in the figures.

The term "comprising" and its derivatives, as used herein, are intended to be open ended terms that specify the presence of the stated features, elements, components, groups, integers, and/or steps, but do not exclude the presence of other unstated features, elements, components, groups, integers and/or steps. This concept also applies to words of similar meaning, for example, the terms "have", "include" and their derivatives.

Moreover, the terms "member", "section", "portion", "part" and "element" when used in the singular can have the dual meaning of a single part or a plurality of parts.

The invention claimed is:

1. A contactor device for high current switching applications in industrial or railways applications wherein a high D.C. current must be switched on and off, the contactor device comprising:

a switch base portion including an electric switching mechanism of a high voltage portion;

an arc extinguishing portion covering the switching mechanism, wherein a couple of moving contacts are driven towards and away from each other with respect to a mutual contact and abutting position, wherein the contacts are mounted at the respective contact ends of a toggle mechanism activated by a low voltage driving portion incorporated in the switch base portion and active on the toggle mechanism.

2. The contactor device of claim 1, wherein the moving contacts are symmetrical and are positioned at the respective contact end of a corresponding elongated arm of the toggle mechanism.

3. The contactor device of claim 1, wherein the toggle mechanism includes a couple of rods having a corresponding end joined in a sliding hinge moveable up and down along a vertical slot of a frame in the switch base portion, wherein the rods are made of an insulating material and have respective opposite ends hingedly coupled to a corresponding end of the arms opposite to the said contacts, respectively.

4. The contactor device of claim 3, wherein each end of the arms opposite to the contacts are sustained by a corresponding elongated portion of an element made by the same insulating material of the rods and are hingedly linked to a respective opposite end.

5. The contactor device of claim 1, wherein each of the elongated arms is pivotally supported in a frame of the switch base portion by a corresponding pivot electrically connected to fixed terminal power contacts projecting outside the switch base portion.

6. The contactor device of claim 5, wherein each of the elongated arms is supported by the corresponding pivot extended transversally at the end of a fork like arm each linked to one of the corresponding fixed terminal power contacts.

7. The contactor device of claim 3, wherein the sliding hinge is contacted by an active end of the low voltage driving portion.

8. The contactor device of claim 1, wherein the low voltage driving portion includes a coil active on a stem having a free distal end linked to one end of a lever, which is pivotally mounted on a fulcrum fixed or integral with an internal frame of the switch base portion, wherein the lever has a second arm with a free end active on the toggle mechanism to activate the switching of the moving contacts.

9. The contactor device of claim 6, wherein an elastic element is interposed between each arm and the corresponding supporting fork like arm for compensating possible degradation or usury of the contacts.

10. The contactor device of claim 2, wherein an arc runner is provided over each of the moving contacts.

11. The contactor device of claim 10, wherein each of the arc runners is electrically connected to a respective dissipation coil provided at the shoulder of each contact end of each arm.

12. The contactor device claim 1, wherein a couple of lateral metal flanges are laterally associated to each moving contact and each metal flange has a projecting flag toward the corresponding arc runner.

13. The contactor device of claim 1, wherein a polar metal plate expansion is provided on both sides of the moving contacts.

14. A power electric system including at least the contactor device of claim 1.

* * * * *